United States Patent [19]

Kupersmit

[11] 4,239,149

[45] Dec. 16, 1980

[54] COMBINATION CLIP AND SEAL CONSTRUCTION FOR SHIPPING CONTAINERS

[76] Inventor: Julius B. Kupersmit, 145-80 228th St., Springfield Gardens, N.Y. 11413

[21] Appl. No.: 58,017

[22] Filed: Jul. 16, 1979

[51] Int. Cl.[3] ..... B65D 45/00

[52] U.S. Cl. ..... 229/45 R; 220/4 F; 206/600

[58] Field of Search ..... 229/45; 220/4 R, 4 F; 206/600

[56] References Cited

U.S. PATENT DOCUMENTS

| | | | |
|---|---|---|---|
| 3,266,656 | 8/1966 | Kridle | 220/4 F |
| 3,374,915 | 3/1968 | Verhein et al. | 220/4 F |
| 3,875,843 | 4/1975 | Maeda et al. | 229/45 R X |
| 3,924,800 | 12/1975 | Desmond et al. | 229/45 R X |
| 3,949,929 | 4/1976 | Kupersmit | 206/600 X |
| 4,019,764 | 4/1977 | Okamura | 229/45 R X |
| 4,167,242 | 9/1979 | Kupersmit | 229/45 R |

*Primary Examiner*—Davis T. Moorhead

*Attorney, Agent, or Firm*—Charles E. Temko

[57] ABSTRACT

A combination assembly clip and sealing means for collapsible shipping containers. The clip is formed from synthetic resinous materials, and may be partially folded to enable it to be inserted into a pair of aligned openings in an assembled container to maintain, for example, a lid in closed condition upon a side wall thereof. After insertion, the clip is returned to planar condition to fully engage the sides of the engaged openings in the container. This movement aligns a plurality of exposed openings in the clip through which a strip-type seal is inserted and closed, thus making it impossible to refold the clip prior to removal to open the container without first destroying the seal.

3 Claims, 5 Drawing Figures

FIG. 1
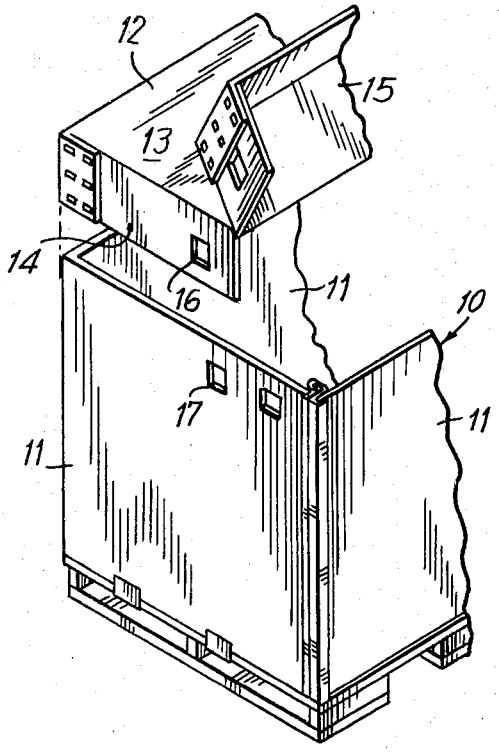
FIG. 3
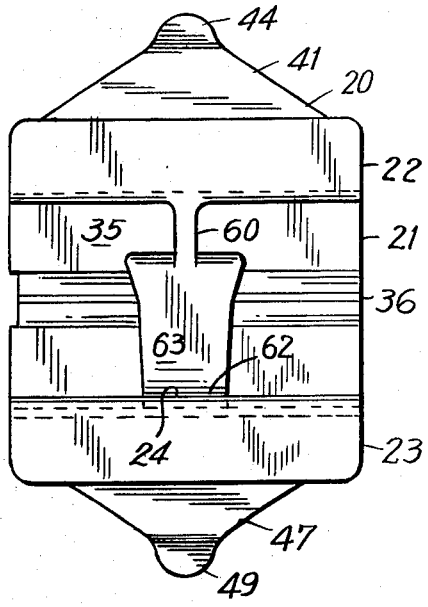
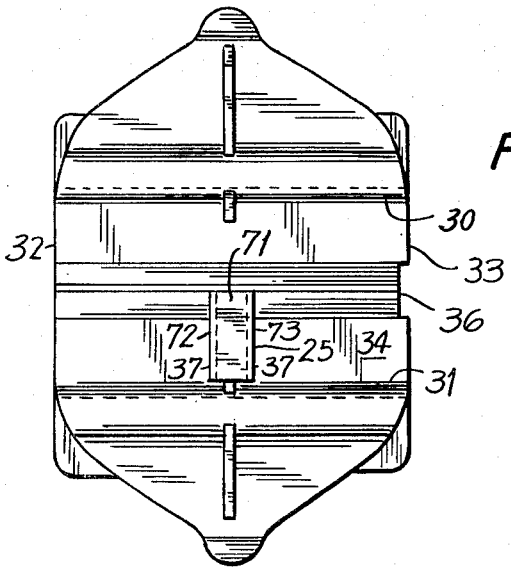
FIG. 2

COMBINATION CLIP AND SEAL CONSTRUCTION FOR SHIPPING CONTAINERS

BACKGROUND OF THE INVENTION

This invention relates generally to the field of collapsible large size shipping containers, of a type, for example, disclosed in my copending application, Ser. No. 941,149 filed Sept. 4, 1978, under the title, "Collapsible Shipping Container Construction," and more particularly to an improved form of synthetic resinous clip adapted to perform the joint functions of closing the lid upon a main body of the container, and effecting a seal which prevents removal of the clip until the seal is breached, thereby providing a means for indicating the presence of tampering.

The problem of pilferage of large shipping containers is well known, irrespective of the form of transportation employed. Where the shipping containers are formed of relatively lightweight materials, such as heavy-grade corrugated board, it has been common practice to provide a seal-retaining means in the form of a metal stamping which is engaged upon an inner edge of a main body portion of the container, and which projects through an opening in the lid to be engaged by a frangible seal. To remove the lid from the main body of the container, it is necessary to destroy the seal. In the case of an unauthorized opening, the presence of tampering is immediately revealed.

To facilitate a rapid and convenient securing of the lid upon the container, there have already been developed in the art a plurality of expandable type clips, usually formed of molded synthetic resinous materials which are of an overall expanded size and configuration corresponding to a pair of alignable openings in portions of the lid and the main body of the container. When the container is closed by placing the lid in position, openings in the lid and container are thereby aligned, and the expandable clip is inserted in unexpanded condition to be thereafter expanded to grip the edges of the openings in both parts of the container, and maintain such parts in abutted relation. In one form of clip, there are two separable elements, one of which fits into the other to expand the outer element to the above-described condition. Another type is formed integrally to include a pair of sections foldable about a transversely extending fold line to move the clip between contracted and expanded conditions. Neither clip has provision for sealing the clip in expanded condition, and, as illustrated in my above-mentioned copending application, a separate seal-retaining means is required. This requirement, in turn, requires the cutting of additional openings for the seal-retaining means, and, of course, the added expense of the forming of the seal-retaining means which, while reusable, is not inexpensive to manufacture.

SUMMARY OF THE INVENTION

Briefly stated, the invention contemplates the provision of a flexible molded clip of the class described, adapted to penetrate the aligned openings in a pair of abutted parts of a shipping container, and engage the edges of said opening when the clip is in expanded condition. Upon movement to such expanded condition, a plurality of openings in the clips themselves are placed in aligned relation to permit insertion of a standard metallic strip-type seal, the ends of which are permanently interconnected, so that it is necessary to cut the strip and disengage it from the aligned openings in the clip before the clip can be disengaged from the aligned openings in the container, whereby the container is opened. Should the seal be tampered with, the presence of pilfering is immediately indicated.

BRIEF DESCRIPTION OF THE DRAWINGS

In the drawings, to which reference will be made in the specification, similar reference characters have been employed to designate corresponding parts throughout the several views.

FIG. 1 is a fragmentary view in perspective of a shipping carton adapted to be used in conjunction with the disclosed embodiment.

FIG. 2 is a rear elevational view of an embodiment of the invention.

FIG. 3 is a front elevational view thereof.

DETAILED DESCRIPTION OF THE DISCLOSED EMBODIMENT

Figure 4:
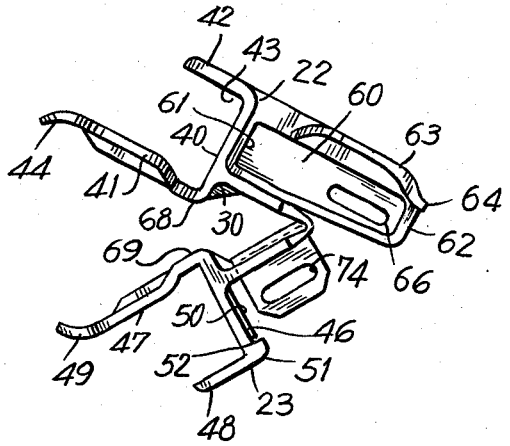
FIG. 4 is a side elevational view thereof, showing certain of the component parts in altered relative position, as compared to that seen in FIGS. 2 and 3.

In accordance with the invention, reference character 10 (see FIG. 1) indicates a shipping container including a plurality of side walls 11, and a flanged lid or cover element 12, including an upper wall 13 and side walls 14. The cover may be provided with an optional foldable flap 15 to permit partial access for filling of the container, and in such case, an additional embodiment of the invention may be used in conjunction therewith. A rectangular opening 16 penetrates the lid element 12 and a corresponding rectangular opening 17 penetrates one of the side walls 11, the openings 16 and 17 being in coaxial alignment when the container is closed.

Referring to FIGS. 2 to 5, inclusive, reference character 20 indicates broadly a clip element 20 embodying the invention, a plurality of such clip elements being used to close the container 10. The clip elements are generally similar, each including a planar main wall 21 carrying upper and lower channel elements 22 and 23 respectively, a latching means 24 and a seal engaging means 25 selectively engaged by a seal element 26.

The wall 21 is of generally rectangular configuration, and is bounded by transverse edges 30 and 31, side edges 32 and 33, an inner surface 34 and an outer surface 35. A fold edge 36 of thinned cross-section extends between the side edges 32–33. A pair of parallel slots 37 accommodates the seal-engaging means 25.

The upper channel element 22 includes a bottom wall 40 communicating with the edge 30, an inner flange 41 and an outer flange 42 which define an interstice 43 into which the abutted walls of the container 10 are fitted. The inner flange 41 includes a camming member 44 to facilitate engagement of these walls when the clip element is expanded.

Correspondingly, the lower channel element 23 includes an upper wall 46, an inner flange 47 and an outer flange 48, the inner flange 47 including a camming member 49. The flange 49 also forms a locking ledge 50 cooperating with a second locking ledge 51 which forms a groove 52.

Figure 5:
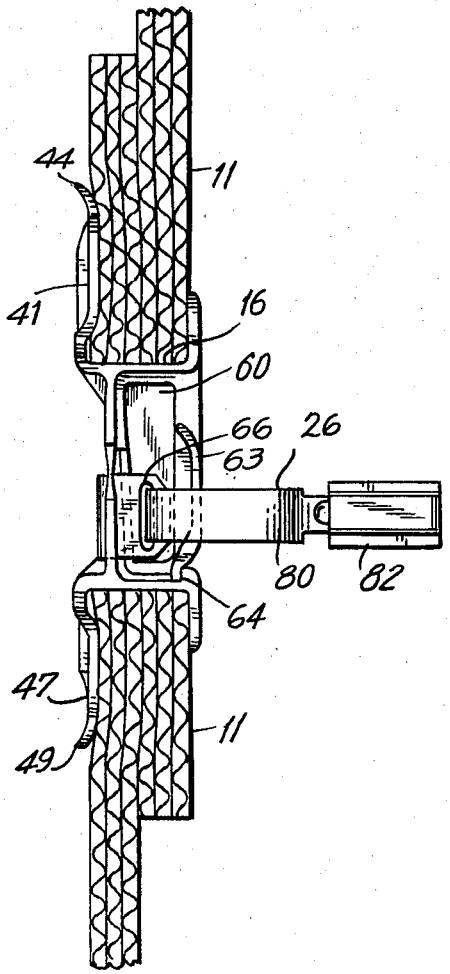
FIG. 5 is a side elevational view thereof, partly in section, showing the embodiment in installed condition within a pair of aligned openings in a shipping carton.

The latching means 24 includes a generally planar member 60 having first and second ends 61 and 62, respectively, and which supports a manually engageable member 63 having a projecting tip 64 which engages the groove 52 when the clip element 20 is pushed from a position shown in FIG. 4 to the position shown in FIG. 5 at the time of installation. The fold edge 36 thus forms first and second relatively movable sections 68 and 69 which permit the clip element to be diminished in size prior to insertion for installation.

The seal engaging means 26 illustrated in the drawing in the form of a metallic stamping which penetrates the slots 37 in the wall 21. the stamping includes a base 71 and upstanding walls 72 and 73, each of which contains a mutually aligned slots 74. When the clip is in expanded condition, the slots 74 are aligned with the slots 66 in the planar member 60.

The seal element 26 is preferable of well-known type including a length of metal 80, a first end of which is insertable into a deformable member on a second end 82, following which the member 82 is compressed to secure the first end therein. It is threaded through the slots 66 and 74 when the clip element 20 is in expanded condition, at which time the slots are in a plurality of juxtaposed planar members, making it impossible to move the clip 20 to a position which permits removal from engagement with the container 10. This movement is possible only by rupturing the length of metal 80 at some point along the enclosed loop which forms the seal, and where such operation is unauthorized, the occurrence of tampering and/or pilfering is immediately apparent.

If desired, the seal engaging means 25 may be formed as a part of the original molding of the remaining elements of the clip element 20, thus eliminating the need for a separate stamping.

It will be apparent that by means of a relatively minor modification to a known clip, it is possible to incorporate a sealing means, whereby the elimination of the usual metallic stamping which forms the conventional seal engaging means in constructions of this type is completely eliminated. The resulting lowering of costs in manufacture is substantial, and the reduction in the amount of manual manipulation necessary to install both the clip and seal is also significantly reduced, with a corresponding increase in convenience to the user.

I wish it to be understood that I do not consider the invention limited to the precise details of structure shown and set forth in this specification, for obvious modifications will occur to those skilled in the art to which the invention pertains.

I claim:

1. In a combination container having a pair of selectively abuttable walls having aligned openings therein, and an expandable clip simultaneously engaging the edges of said aligned openings to maintain said walls in abutted relation, the improvement comprising: said clip having first and second sections relatively movable between a first position in which the overall size of said clip is relatively diminished, and a second position in which the overall size is relatively enlarged to engage said edges of said openings in said container, said clip having a plurality of openings therein which are placed in alignment when said clip is in said second position; and elongated seal means penetrating said last-mentioned openings to prevent movement of said sections from said second positon.

2. The improvement in accordance with claim 1, further characterized in said first and second sections being hingedly interconnected and having latching means maintaining said clip in said second position, said seal means penetrating a portion of said latching means.

3. The improvement in accordance with claim 2, further characterized in said alignable openings in said clip being three in number, and disposed in a corresponding number of juxtaposed planar members.

* * * * *